US006588108B2

(12) United States Patent
Talavera

(10) Patent No.: US 6,588,108 B2
(45) Date of Patent: Jul. 8, 2003

(54) HAIR TRIMMING DEVICE WITH REMOVABLY MOUNTABLE COMPONENTS FOR REMOVAL OF SPLIT ENDS AND STYLING OF HAIR

(76) Inventor: Victor C. Talavera, 2412 Victoria Cir., Alpine, CA (US) 91901

( * ) Notice: Subject to any disclaimer, the term of this patent is extended or adjusted under 35 U.S.C. 154(b) by 0 days.

(21) Appl. No.: 09/844,137

(22) Filed: Apr. 27, 2001

(65) Prior Publication Data

US 2002/0157262 A1 Oct. 31, 2002

(51) Int. Cl.[7] ..... B26B 19/44
(52) U.S. Cl. ..... 30/133; 30/30; 30/124
(58) Field of Search ..... 30/30, 124, 133, 30/195, 233, 123, 194, 205, 206

(56) References Cited

U.S. PATENT DOCUMENTS

| | | | | | |
|---|---|---|---|---|---|
| 3,015,336 A | | 1/1962 | Caples | | |
| 3,115,143 A | | 12/1963 | Queen | | |
| 4,314,405 A | * | 2/1982 | Park | | 30/133 |
| 4,868,984 A | * | 9/1989 | Elsherbini | | 30/133 |
| 5,213,116 A | | 5/1993 | Stein | | |
| 5,519,939 A | * | 5/1996 | Smith | | 30/30 |
| 5,724,736 A | * | 3/1998 | Smith | | 30/133 |
| 5,884,402 A | * | 3/1999 | Talavera | | 30/124 |

* cited by examiner

*Primary Examiner*—Hwei-Siu Payer
(74) *Attorney, Agent, or Firm*—Donn K. Harms

(57) ABSTRACT

A hand held hair trimming device which when pulled through the hair cuts only a determined portion of the ends of hair strands while leaving adjacent hairs uncut. The device will cut a predetermined length off only the distal ends of the hair shafts each time it has the hair drawn through its serpentine channel. Angled encounter of the distal ends with the cutting blade is prevented by ridges and apertures encouraging such contact only at subtantially straight angles. The device may be held in either hand allowing the hair pass through in either direction by merely changing the rotational direction of the motor by moving the thumb switch. The blade section of the device may be adjustable for changing the amount of the determined length to be cut from the hair shafts or may be removable and replaceable with one of a plurality of differently configured blade assemblies thereby allowing for easy adjustment of the trimmed amount.

19 Claims, 3 Drawing Sheets

HAIR TRIMMING DEVICE WITH REMOVABLY MOUNTABLE COMPONENTS FOR REMOVAL OF SPLIT ENDS AND STYLING OF HAIR

BACKGROUND OF THE INVENTION

1. Field of the Invention

The present invention relates to an improved device for the trimming of the hair. More particularly it relates to a device which will trim a predetermined substantial equal amount from the ends of the individual hair shafts distal from the hair follicles for removal of the split ends derived from frequent combing and washings. The predetermined lengths of the hair shafts are thus trimmed while leaving adjacent longer hair shafts intact. The device also features removable blade mechanisms for user adjustment of hair trim length and optionally hair drying.

2. Prior Art

Because of the changing styles and the inevitability that the hair on a person's head will grow and need to be cut, visits to hairstylists and barbers are a common occurrence in the United States and throughout the world. Hairstylists and barbers are trained in the art of cutting hair to their clients specifications using motorized and hand held implements such as scissors and electric clippers. Sometimes the person desires a new hairstyle, but more often they are happy with the hairstyle and only require a given amount cut from the ends of the hair shafts. However, one vexing problem exists whether the hair on a persons head is being cut by a trained stylist of the individual needing the trim or an amateur, split ends must be removed to keep the hairstyle looking good. Split ends are a constant and continuous product of combing and brushing of hair and can cause the hair to look unhealthy as well as just unfashionable.

The current method of trimming split ends, either by the highly trained stylist or the amateur involves a time-consuming process. The hair must be stretched relatively taught using the hand or a comb or combination thereof, and delicately trimming only the ends of the individual hairs distal from the follicles on the scalp. An errant cut will yield harsh marks, uneven cuts, or other undesired results in the head of hair of the person receiving the hair cut.

Split ends are an especially vexing problem in the case of hair shoulder length and longer in styles worn by women and men. Because of the varying length of the strands of hair involved from the ears down to the shoulders or below, it is especially time consuming to try and trim only the ends of the hair, a very small relatively equal amount, while not accidentally cutting long adjacent strands. This process is made even harder when the style of cut is tapered through the length and just the short ends require cutting maintaining the tapered style. Hours can be spent by professional hair stylists trying to trim the split ends on a persons' long hair. It is virtually impossible for a person with long hair to trim the split ends themselves as cutting the split ends of the hair on the back of one's head, using a mirror and scissors is a task fraught with peril. One slip and the hairstyle could be ruined by cutting some long strands of the hair laying adjacent to the distal split ends on shorter hair shafts. A number of devices have been developed over the years for trimming hair to be used by amateurs and professional hair stylists alike. Such devices attempt to allow amateurs to cut hair into professional looking styles or to enhance the ability of professional stylists by giving them another tool for their trade.

While many of these devices address the issue of cutting hair and styling it, few devices address the issue of split ends on the distal ends of the hair and removing only a predetermined short length of the unhealthy distal ends. Further, on very long hair, even if the ends are not split, all hair does not grow at the same rate and the aged distal hair shaft ends are often removed as a cosmetic aid to beautifying the head of hair getting rid of frizzy and unattractive hair ends. To remove such damage or unattractive hair shaft ends without ruining the hair style of the individual or causing major change in styles requires that only the short pieces of the distal ends of the hair shafts be cut off without disturbing longer adjacent healthy normal appearing hair shafts. This can be very tedious if not an impossible task with the hundreds of hairs on an individuals' head.

U.S. Pat. No. 5,519,939 (Smith) teaches a combination of a rotating brush, comb and razor blade arranged to cut a broad swath of hair when in use. However, Smith requires many adjustments by the individual using the device and it is intended to cut long pieces of hair as determined by the circumference of the rotating brush. This device, because of its arrangement cannot be configured to cut only a short length of hair from the distal ends of the hair shafts in relatively equal amounts as required to trim split ends and unhealthy or unattractive hair ends. Further, because it is drawn through the hair by hand to rotate the brush, the user is in a constant peril of having hairs wrap around the brush into a tangle or of pulling the device sideways through the hair and accidentally cutting off broad swatches of adjacent hair. Often these razor blade cutters pull the hair to cut, rather than shearing action for hair for removal. This pulling may produce a great deal of discomfort for the individual receiving the hair cut.

U.S. Pat. No. 5,026,088 (Queen) teaches of a guide for trimming hair whereby a user can taper or feather the cut of the hair from the neckline to the temples. This device however requires holding the guide in one hand and the electric clippers in the other. Such an arrangement precludes use by an individual in cutting their own hair, and requires constant attention and the skill of a stylist or second person to cut the hair on which the device is being used. It would be virtually impossible for a user to cut the hair on the back of their head in this manor and Queen's patent by its own teaching addresses tapering and feathering of haircuts rather than just the removal of split ends. Further, it would be virtually impossible without great effort and time, to cut only a substantially equal portion from the distal end of individual hair strands while leaving adjacent longer hair strands untouched with this device.

U.S. Pat. No. 5,213,116 (Stein) teaches of a hair trimming device using a rotatable blade on a comb like guide. This device is however designed to cut bangs rather than split ends and because as taught, it requires two hands to use it, it is unlikely that anyone could use this device on the back of the head without the aide of another individual to guide the device. Again, trimming substantially equal amounts from the distal ends of hairs would be extremely time consuming and require great dexterity if it could be accomplished.

U.S. Pat. No. 5,884,402 (Talavera) teaches of a unique device that accomplishes the difficult task of cutting only the distal ends of the hair strands, and can be used by a trained hair stylist or an amateur. This hair trimming device can also be used by a single individual, with some limitations. The motor driving the cutting blades is taught as only spinning in one direction allowing that the instrument must be used in the right hand only and the hair need to enter on one side only. Also the limited hair guides on the face of the device while functional, do not necessarily allow that the hair to always follow a straight path over the roller when passing through the device and the cutting blades require a better shearing action to effectively cut the distal ends of the hair strands.

Thus, there is a continuing need for improvement in devices used in the field of hair styling, in particular where the cutting split ends and trimming a predetermined length off the ends of the hair is required.

SUMMARY OF THE INVENTION

The applicant's device is a component interchangeable hair maintenance tool which provides a user configurable hair trimmer used for trimming substantially equal short pieces of hair shafts which form split ends or unattractive or unhealthy hair ends. Various components may be added or traded onto the device to change the length of hair trimmed, dry the hair, or allow for the use of shears to cut certain portions of the hair if desired. The split end cutting operation takes place by only removing the distal ends of the hair, while leaving adjacent shafts of longer hair lengths uncut until the device reaches the distal ends of those strands.

Several improvements incorporated into the operation of this device serve to enhance or improve that operation. These improvements include interchangeable components which may be removed or substituted to change the length of hair trimmed, allow for hand trimming, or drying the hair while concurrently straightening it. When sold or provided for use in a kit form, the improvements provided by the various components can be interchanged by the user to yield the desired outcome. These improvements all enhance the ability of the device when used in conjunction with the novel serpentine movement of the hair through the device whereby the ends of the hair shafts flip up into the cutting blades as they pass over the central structure of the hinged retainer, while the longer hair shafts remain held against the retainer central section until they reach their distal ends.

With the improved unit the hair shafts are held against an angular pressure unit by the means of the operator pressing the retainer-activating lever against the handle to raise the hinged retainer into the operating position. The degree of angle on the angular pressure unit determines how long the strands of hair are retained before the ends flip up into the blade of the cutter assembly. Several different degrees of angle are available on the pressure unit so that different lengths of hair may be cut off. The angular pressure unit slides in and out of the cutter head by the means of two dovetails formed on the sides of the retainer cavity. Two, matching dovetail grooves in the angular adjustment unit allow that a number of different units with different angles be used in the device. With the novelty of this incorporation, as the hair passes through the serpentine channel of the device, the individual may by the means of the cut length adjustment mechanism, determined the precise amount of hair that is removed from the hair shafts.

A unique hair cutting assembly component and drive system has been created whereby a rotational direction switch determines both on and off and the direction the motor will drive the cutting blade. In doing this the hair trimmer may be held in either hand, with the hair passing through the serpentine hair channel form left to right or from right to the left. The removable cutter assembly retained in the cutter head has an internal gear drive wheel attached to the cutter blade that rotates within a blade frame, held in place by nylon bushing at either end. The drive motor within the cutter body has a gear system with a fixed gear that extends out to engage the internal gear wheel on the cutter assembly. Two shear plates mounted on each side of the frame allow that the blade may rotate in either direction and cut effectively. The shear plate(s) have a retaining edge and two retaining tabs to hold them in a precise location on the blade frame, while the shearing edge turns down to engage the shearing edge of the cutter blade. Mounting the shear plates to the blade frame is accomplished by the means of three self-tapping screws that translate through flex rings enabling the shear plates to be flexible and maintain a uniform pressure against the cutting blade edge surfaces.

The hinged hair retainer that rotates into the retainer cavity of the cutter head has typical side configurations of a brush head. Each side incorporates a plurality of spines along the outermost edge and a series of ridges located on the flat surface insuring that the hair is retained in the plurality of spines of the detachable spine units attached to the cutter head. The detachable spine units will be available in sets, with varying number and length of spines, along with different degrees of flexibility in the composition of the plastic from which they are made.

The hair retainers' central structure, where the hair rotates around to flip up into the cutter blade, has a smooth curved surface and a plurality of teeth maintaining the straight flow of the hair shafts through the serpentine hair channel. Hair trimming may also be accomplished without the aide of the detachable spine units, allowing the hair to pass directly over the surfaces of the cutter head with the hair being guided by the spines and teeth on the hair retainer only.

The cutter head assembly can be provided as a single attachable unit or in kit form with a plurality of head assemblies each having a plurality of small raised ridges that engage in a continuous slot around the mating end of the cutter body holding it securely in position but allowing that it may be removed with a slight axial pressure. The cutter head consists of two side lobes with the retainer cavity between. Each of the side lobes has four orifices for attaching the detachable spine units with the retainer cavity located between the lobes, and a single top lobe with a removable transparent door for cleaning the cut hair ends from the internal containment area. A locking pin translates outwardly from the cutter body above the cutter assembly adjacent to the mating ends, through an orifice in the cutter head and a matching orifice in the end of the transparent door. The locking pin insures that the door is closed when the cutter blade assembly is connected to the motor providing a means for safety closure for the device since the blade will not operate unless properly seated depressing the pin. Another safety protection is a grill in the retainer cavity that the hair flips up through to engage the cutter blade has 0.375 inch spaces and will not allow enough room to put a finger into the cutting blade.

The cutter body houses the electric drive motor for the cutter head. It also retains the pivot mechanism for the hair retainer and the retainer-activating lever. The rotational direction switch is located conveniently where it may be activated with the thumb while the fingers work the retainer-activating lever. In the handle mating cavity there will be two power prongs and a ground prong with mating orifices in the handle when the device is used with a house power connection cord or as shown with two power contacts, when used with battery's or rechargeable sealed power handle.

Another embodiment of the device would feature the cutter body assembly having two parallel side lobes extending from the body assembly opposite the handle attachment to the body assembly. This embodiment would feature mounting pins on the rear side of the side lobes on a side opposite the slot. These pins would provide mounts for attachable blade assemblies, a hair drying component, or when such components are removed, access to the hair communicating through the slot so that the ends may be shear trimmed by hand if desired.

It is an object of this invention is to create a hair trimmer that can cut a more precise length of hair off the distal end of hair strands.

Another objective of this invention is to create a device that can be operated by an individual in either hand, and drawing the hair through the serpentine channel in either direction by the means of adjusting the direction of the rotation of the electric motor with a switch.

Another objective of this invention is to create a device with a means of continuous control of the hair passing through the serpentine channel made possible by the spines on the hair retainer, the spines on the detachable spine units and the teeth on top of the retainer central structure.

Still, another objective of this invention is to supply a cutter with different length adjustment mechanisms that can guarantee the precise lengths of the trimmed ends of the hair shafts.

An additional object of this invention is design a unique cutting blade assembly that can cut equally well in either direction of rotation, with a means of flexible resistance on the two shearing surfaces.

Further objectives of this invention will be brought out in the following part of the specification, wherein detailed description is for the purpose of fully disclosing the invention without placing limitations thereon.

BRIEF DESCRIPTION OF DRAWING FIGURES

FIG. 1 is a perspective view of the hair trimming device with the cutter head assembly, cutter blade assembly and the handle, exploded away from the cutter body. The retainer-activating lever and the hair retainer are in the relaxed open position. The transparent hair removal door and one of the detachable spine units are shown exploded away from the cutter head assembly.

DETAILED DESCRIPTION OF PREFERRED EMBODIMENTS OF THE DISCLOSED DEVICE

Figures 1, 2:
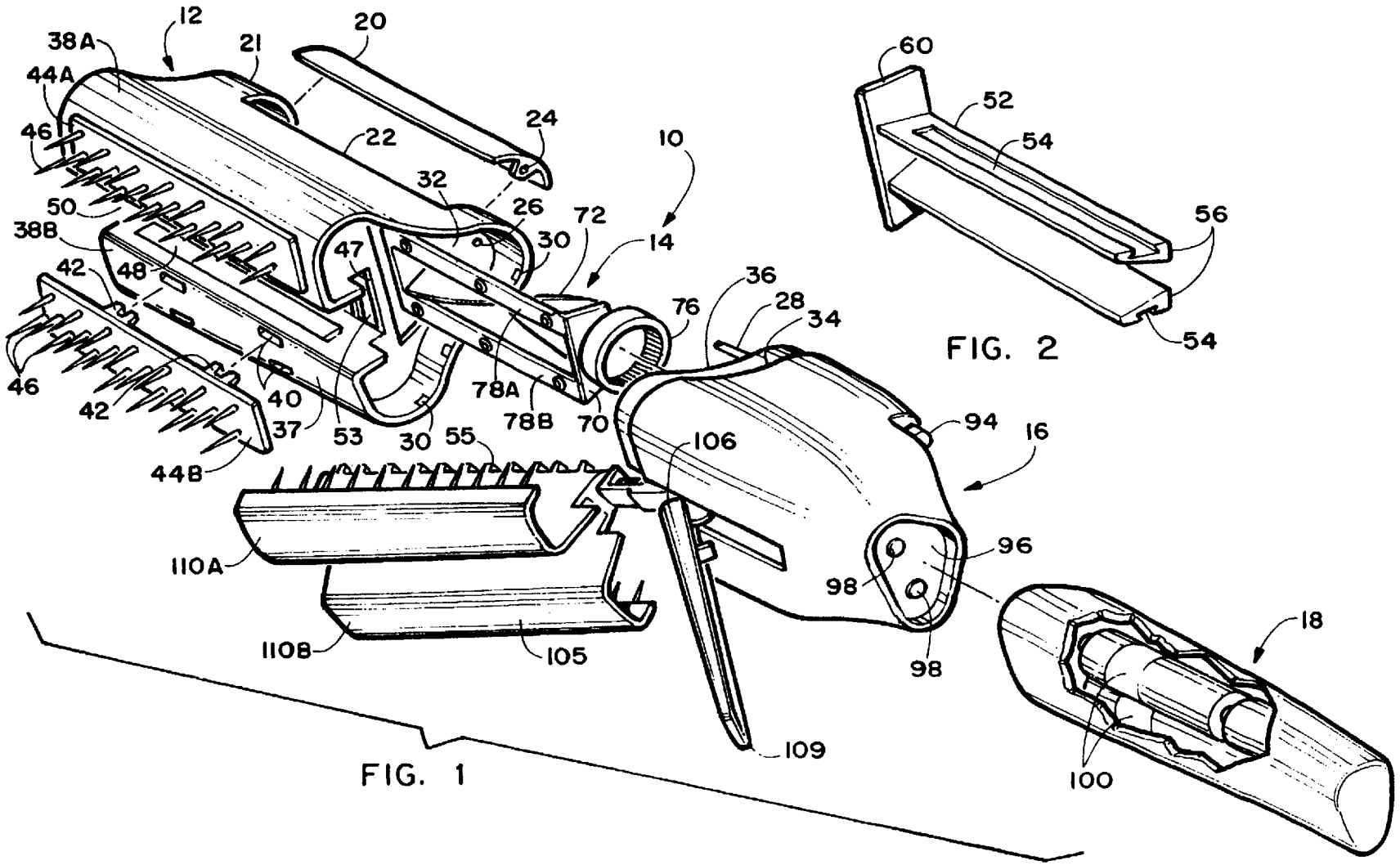
FIG. 2 is a perspective view of the cut length adjustment mechanism.
Figure 4:
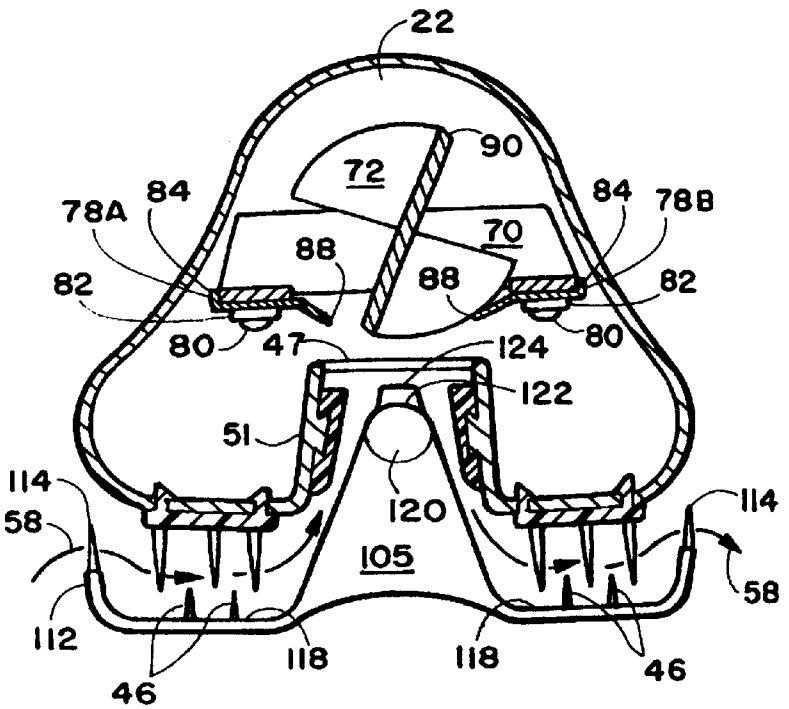
FIG. 4 is a section through the cutter head assembly and cutter blade assembly with the hair retainer not shown in cross section.
Figure 3:
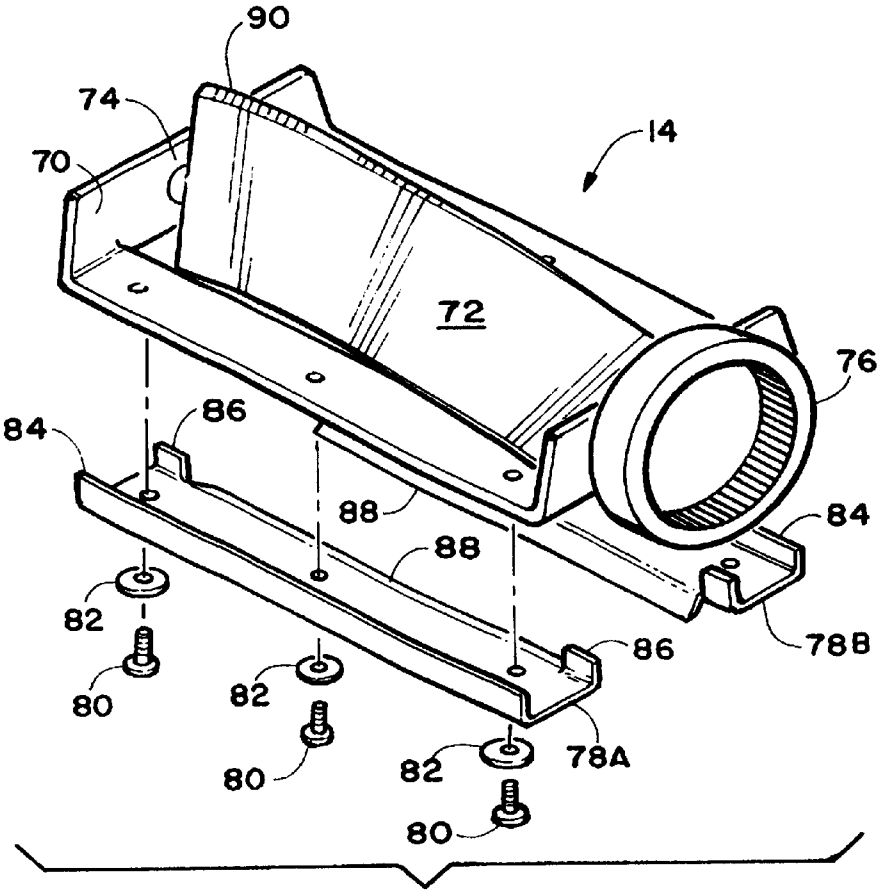
FIG. 3 is a perspective view of the cutter blade assembly showing the two shear plates exploded down with the rubber flex rings and mounting screws.

Referring now to the drawing FIG. 1 showing an exploded perspective view of the hair trimmer assembly 10. The cutter head assembly 12, the cutter blade assembly 14, the cutter body assembly 16 and the handle 18 are the major components of the hair trimmer assembly 10. The cutter head assembly 12 is shown with the transparent hair removal door 20 exploded away from the top lobe 21 of the internal containment area 22 that holds the cut ends of the hair shafts 23 drawn through the device and trimmed. The locking orifice 24 in the end matches the orifice 26 in the cutter head that is in alignment with the locking pin 28 located in the cutter body 16 so that when the cutter head assembly and the cutter body are assembled, the hair removal door 20 cannot be removed thereby providing a means to prevent access to the internal containment area 22 during operation of the device 10.

A plurality of raised ridges 30 around inside perimeter edge of the female end 32 of the cutter head assembly 12, provides a means of registered engagement of the cutter head assembly 12 to the cutter body 16 for attachment thereto using a continuous recess 34 around the inner edge of the male mating end 36 of the cutter body 16 and thereby retaining the two parts together under normal operation. A slight axial pressure will disengage the cutter head 12 from the cutter body 16. Once so removed, the hair removal door 20 can be taken off the cutter head assembly 12 to allow for cleaning the internal containment cavity 22 as a reservoir for the distal ends cut from the cut hair shafts 23.

The face 37 of cutting head assembly 12 has two side lobes 38A and 38B have orifices 40 for engaging the locking tabs 42 of the detachable spine units 44A and 44B. The detachable spine units 44A and 44B will be available in sets, with a varying number and length of spines 46 along with different degrees of flexibility in the composition of the plastic that parts can be made from. Of course the spines 46 could also be formed into the two side lobes 38A and 38B if removability is not desired, however the current best mode employs removable spine units 44A and 44B.

For the safety of the operator a grillwork 47 has been incorporated in the elongated slot 51 of the retainer cavity 50. This grillwork 47 features grill apertures 53 therein thereby allowing enough room for the distal ends of hair shafts 23 to communicate therethrough for cutting by the cutting blade 72, but not enough room to insert a finger. This provides a safety means to eliminate potential injury of the user's finger by the cutting blade 72. The grill apertures 53 formed in the grillwork 47 also provide a means for hair alignment of the distal ends 25 of the hair shafts 23 with the cutting blade 72 by providing communication through individual apertures in the grillwork 47 to prevent distal ends of hairs 25 from encountering the cutting blade 72 at angles thereby aligning the distal ends of hair shafts 23 communicating therethrough with the cutting blade 72.

The hinged hair retainer 105 rotates into the retainer cavity 50 formed between the side lobes in the cutter head assembly 12 by means of the pivot mechanism 106 when retainer-activating lever 109 is compressed by the fingers of the operator against the cutter body 16 or it could be spring loaded to be so compressed with the operator therein opening raising the hair retainer 105 by pressing the lever 109 however the current best mode features the configuration whereby the user compresses the hair retainer 105 into the retainer cavity 50. The hair retainer 105 consists of two matching sides 110A and 110B that operatively engage with lobes 38A and 38B of the cutter head assembly 12. The outer edges 112 of the matching sides 111A and 110B have a plurality of spines 114 to guide the hair shafts 23 through the serpentine hair channel 58. The surface of the hair retainer 105 adjacent to the slot 55 when the hair retainer 105 is recessed into the retainer cavity 50 in the current best mode has a plurality of ridges 51 with gaps in between each ridge 55 which line up with the grill apertures 53 and form a plurality of serpintine pathways for hair to traverse through the device 10 in use. Engagement of the ridges 55 with the grill also serves to maintain the hair shafts 23 in a subtantially straight path through the device thereby avoiding the potential for angled communication of distal ends 25 of hair shafts 23 with the cutting blade.

The opposing sides surfaces 107 of hair retainer 105 are angled to cooperatively engage the angular pressure sides 56 of face plate 60 and compress the hair shafts 23 traveling in the serpentine channel 58 thereby tensioning the hair shafts 23. Compressing the hair retainer 105 into the retainer cavity 50 thus imparts tension to hair shafts 23 being pulled through the serpentine hair channel 58 formed by the cooperatively engaged hair retainer 105 and retainer cavity 50. Spines 46 of the detachable spine units 44A and 44B, are located on the flat surface of the spine units 44A and 44B and engage the flat surface 118 of the cooperatively engaged hinged retainer 105 and help to form defined paths in-between the spines 46 and the teeth 124 on the surface of the hair retainer 105 for the tensioned hair shafts 23 to travel thereby keeping the hair shafts 23 traveling in the serpentine hair channel 58 running in a straight path while traversing the device 10 during use. This straight path alleviates any potential of distal ends of hair shafts 23 accidentally angling during travel through the serpentine hair channel 58 and causing too much of the distal ends to be cut by the cutting blade 72.

The hair central structure 120 of hair retainer 105, over which tensioned hair shafts 23 travel thereby causes the distal ends of these hair shafts 23 to flip up and through the elongated slot 51 and to be cut between the flexible shearing edge 88 and cutter blade edge 90 when tension on the distal ends is momentarily relieved once the distal ends loose contact between the hair retainer 105 and angular pressure sides 56. The central structure 120 has a smooth curved surface 122 and defined radius and in the current best embodiment, a plurality of teeth 124 help maintain a straight flow of the hair shafts 23 in the defined path through the serpentine hair channel 58 and urge the distal ends of the hair shafts 23 through the adjacent grill apertures 53 adjacent thereto where they may be cut a determined length. Registering the positions of the grill apertures 53 and teeth 124 such that the teeth 124 are inline with the metal portion between the grill apertures 53 further channelizes the defined path for the hair shafts 23 traversing the device 10.

A dovetail 48 is incorporated on either side of the retainer cavity 50 to facilitate the incorporation of one means to adjust the cut length of the hair removed from the distal ends of hair shafts 23 communicated through the elongated slot 51 and to the cutting blade 72 in the form of the cut length adjustment mechanism 52. The cut length adjustment mechanism in this embodiment features dovetail grooves 54 in the two angular pressure sides 56 allow the mechanism to slide in place over the dovetails 48 in the retainer cavity 50. Different angles formed on the pressure sides 56 will change the pressure imparted to the hair shafts 23 being drawn through the serpentine hair channel 58. This is because tension upon the hair shafts 23 is proportional to the amount of surface area of the pressure sides 56 which contacts the hair retainer 105 when cooperatively engaged. Changing the angle of the pressure sides 56 thus changes the contact surface area and adjusts the tension on the hair shafts 23. More tension on the hair shafts 23 and a longer surface area contact will cause a shorter distal end to communicate with the cutting blade 72 and conversely less surface area contact will cause a longer strand to communicate with the cutting blade 72 since the distal end of the hair shafts 23 will lose contact earlier and pop up through the elongated slot 51 when tension is lost. The faceplate 60 retains the two angular pressure sides 56 and encloses the end of the retainer cavity 50. A plurality of such faceplates 60 could be supplied or available for use with the device 10, each having differently angled sides 56 to provide differing surface area contact and hence different tension and release points on the hair shafts 23 drawn through the serpentine hair channel 58 thereby adjusting the amount of hair trimmed from the distal end of hair shafts 23 drawn therethrough.

The cutter assembly 14 slides within the inner containment area 22 of the cutter head assembly 12. In some cases the cutter blade assembly will be permanently in place within the internal containment area 22. Cutter frame 70 holds the cutting blade 72 between two bushings with the internal gear drive wheel 76 mounted axially on the outside of the frame 70. Two shear plates 78A and 78B mount to the frame 70 by means of mounting screws 80 translating through flex rings 82. Shear plate retainer edge 84 and two shear plate retainer tabs 86 keep the shear plates 84 in a precise location. The flexible shear plate edge 88 and the cutter blade edge 90 perform the shearing action required to effectively cut the hair shafts 23 at the ends. With the opposing locations of shear plate 78A and shear plate 78B, and the unique configuration of the cutting blade 72, the cutting action will work in either direction of rotation that the drive motor is turning. The use of the shear plates 78A and 78B provide an additional means to adjust the cut length of the hair removed from the distal ends of hairs communicated through the elongated slot 51. Varying the thickness of the shear plates 78A and 78B will move the cutting blade 72 closer to or further from the distal ends of hairs communicated to the cutting blade 72 and thus provide a means to adjust this cut length. Consequently the device could be provided with a plurality of differently configured cutter blade assemblies 14 each having shear plates configured to move the cutting blade 72 closer to or further from the elongated slot 51 through which the distal ends of hairs are communicated to the cutting blade 72.

The cutter body 16 houses the conventional drive motor and gear system to cooperatively engage and drive the cutter blade 72 through the internal gear wheel 76. A means to change the rotation direction of the cutter blade 72 is provided by a rotational direction switch 94 which reverses the direction of the DC current provided to the drive motor and is conveniently located at the top of the unit to be activated by the thumb. Of course those skilled in the art will recognize other manner of reversing the direction of the motor and such are anticipated. Changing the motor rotation direction while not imperative, enhances the function of the device in the current best mode in that it allows the device 10 to be used by either hand of the user by spinning the cutting blade 72 in the correct direction for the direction in which device 10 is being pulled. This is required because the user pulling with his left hand must flip the device 10 over when using it with the right hand and the cutting blade 72 being a rotating scissor, much like hand scissors, works best when cutting in one direction in relation to the direction the device 10 is being pulled.

Another means to adjust the cut length of the hair removed from the distal ends of hair shafts 23 communicated through the elongated slot could be provided using an embodiment of the device wherein the cutter head assembly 12 and the cutter blade assembly 14 are provided as a single unit cutting head attachable to the cutter body assembly 16. In this embodiment, a plurality of single unit cutting heads would be provided each configured with the cutting blade 72 closer to or further from the elongated slot 51 thereby cutting a determined amount of the distal end of hair shafts 23 communicating through the elongated slot 51. By providing a plurality of differently configured single unit cutting heads in a kit form, the user simply needs to mount the appropriate single unit cutting head to the body assembly 16 and can change the length of the distal ends of hair shafts 23 cut, by changing to a differently configured singe unit cutting head.

As depicted, the handle mating cavity 96 houses the electrical connections 98 which communicate with the electric motor in the cutter body assembly 16. The power communicated would be from batteries 100 in the handle 18 or a transformer connected to conventional AC power. In the preferred embodiment of the device, the batteries 100 are housed in the handle 18 and are disposable batteries, or a sealed rechargeable battery which would recharge in a conventional fashion by engagement with a charging stand. The handle 18 has an attachment end which locks into cavity 96 of the cutter body assembly 16, to be removed by a slight axial pressure.

While the device is depicted featuring a handle 18 cooperatively engageable with a cutter body portion 16 the two could both be a single unit of unitary construction and still yield the functional benefits of the device as the detachable cutter head 12 and/or removable cutter blade assembly 14 still would allow for easy change in the amount of hair cut from the distal ends of the tensioned hair shafts 23 traversing the serpentine hair channel 58.

Figure 5:
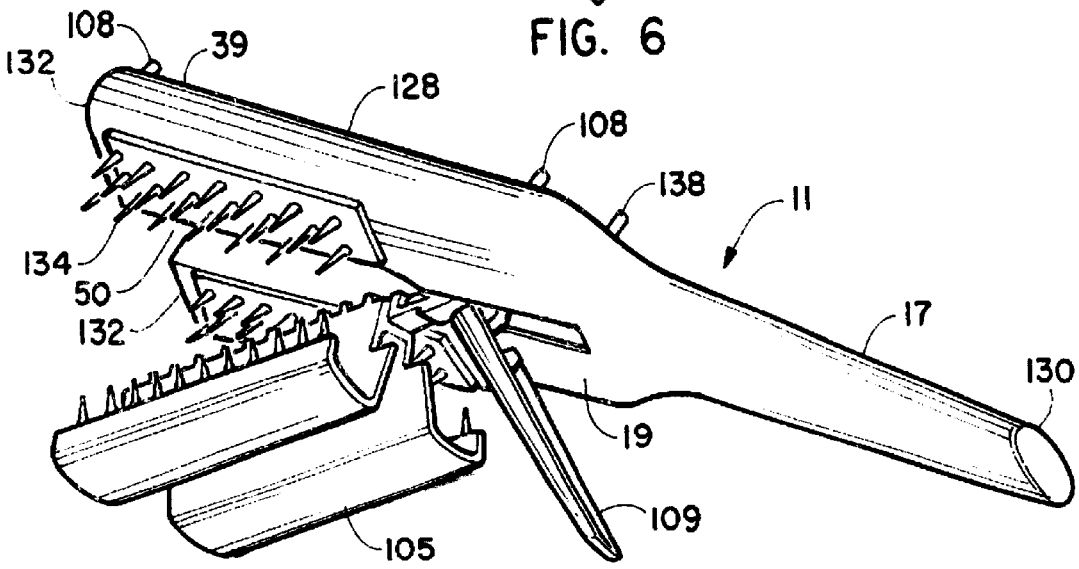
FIG. 5 depicts another modular embodiment of the device with a removable shear assembly allowing replacement of differently configured shear assemblies or use of scissors.

FIG. 5 depicts another embodiment of the disclosed device which allows for the ability to detach and change the cutter blade assembly 14 through the attachment of a cutting unit 126 having the motor cooperatively engaged with a cutting head assembly 12 and cutter blade assembly 14 and batteries 100 all mounted in a single cutting unit 126. Electrical contact with the switch 94 would be provided by cooperatively engageable electrical contacts 138 on the forks 132. The same contacts 138 could also be used to provide communication to the charger for batteries in the cutting unit 126, or from batteries 100 in the handle 130. This embodiment would still give the advantages of a detachable cutter blade assembly 14 and the ability to adjust the distance of the cutting blade 72 to change the length of hair cut from the distal ends of hair shafts 23 with the additional benefit of being able to detach the cutting unit 126 and use scissors should such be desirable in some instances. This embodiment would feature a one piece body 128 having a handle 130 at one end and a pair of forks 132 defining a cutting slot 134 between the forks 132. In use, the cutting unit 126 would operatively engage the back side of the forks 132 opposite the front side of the forks which would engage with the hair retainer 105. Hair shafts 23 would thus follow the same serpentine path on the front side of the forks 132 and pop up in the cutting slot 134 to be cut by the attached cutting unit 126 or in certain instances the cutting unit 126 might be left off and scissors could be used to cut the distal ends of hair shafts 23 rising through the cutting slot 134.

Figure 6:
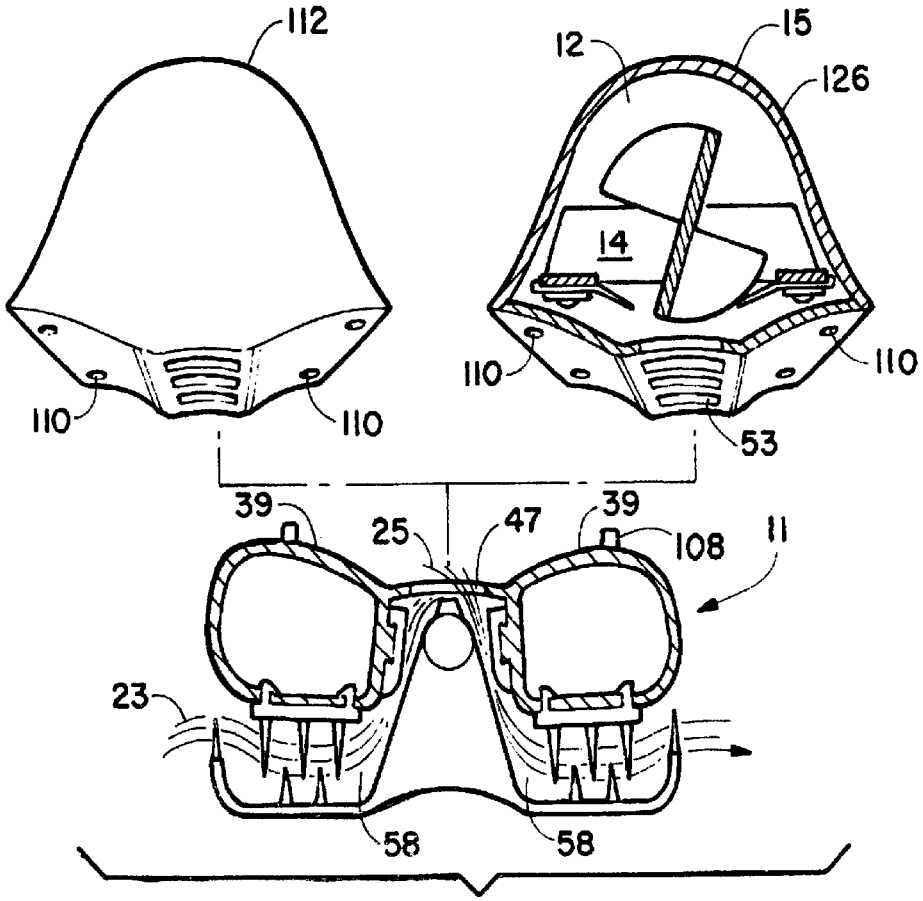
FIG. 6 depicts another preferred embodiment which provides rear facing mounts for attachable blade assemblies, a hair drying component, or when such components are removed, access to the hair communicating through the slot so that the ends may be shear trimmed by hand if desired.

Another preferred embodiment of the device 11 is depicted in FIG. 6. This embodiment works in the same fashion as the above mentioned embodiments in that it forms the serpentine pathway 58 for hair shafts 23 using the hinged retainer 105 cooperatively engaging in the retainer cavity 50. Hair shafts 23 drawn therethrough momentarily have their distal ends 25 pop up where they may be cut off in the aforementioned fashion.

This embodiment of the device 11 features a handle 18 having a front face 19 and a rear face 17. The first side lobe 38*a* and second side lobe 38*b* are attached to the handle 18. The retainer cavity 50 is thereby formed between first and second side lobes 38*a* and 38*b*, terminating at their communication to the handle 18. The elongated slot 51 is situated at the base of the retainer cavity 50 and communicates therethrough and in-between the rear faces 39 of the first and second side lobes 38*a* and 38*b*.

The cutter blade assembly 14 is mounted in the cutter head assembly 12 which is attached to the cutter body assembly 16 all in one cutting unit assembly 15. This forms a cutting unit assembly 15 which mounts to the rear faces 39 of the first and second side lobes 38*a* and 38*b* using mounting pins 108 which are placed to register with and cooperatively engage mounting apertures 110 in the front face of the cutting unit assembly 15. A means to communicate electricity to the motor in the cutting unit assembly 15 is provided by the mounting pins 108 also being electrical contacts which engage cooperative electrical contacts in the mounting apertures 110 which communicate with the drive motor mounted inside the cutting unit assembly 15.

This secondary embodiment 11 allows for the easy mounting and dismounting of the entire cutting unit assembly 15 and thus the cutter blade assembly 14 in one quick action. Consequently the device 11 could be provided with a plurality of differently configured cutting unit assemblies 15 which would be mountable using the mounting pins 108. With each such cutting unit assembly 15 being configured to cut a different defined length of hair from the distal ends of the hair shafts 23, the user can easily adjust the amount of hair being removed by simply changing to a different cutting unit assembly 15 which is configured to cut the specific length of hair from the distal ends 25 of the hair shafts 23. Power communicated through the mounting pins 108 could be provided in the aforementioned fashion from batteries stored in the handle 18 or AC power from a chord communicated to the mounting pins 108.

This alternate embodiment of the device 11 also affords function additional functions and utility using the serpentine hair channel 58 which causes the distal ends 25 to pop up through the elongated slot 51. First when the cutting unit assembly 15 is removed, shears (not shown) could be used to cut very specific distal ends 25 when they rise through the elongated slot 51 and can be viewed. Second, a hair drying component 112 could also be supplied in the kit of attachable components. The hair drying component 112 would use conventional blow drying components of a heat source and fan and the device 11 could then be brushed through the hair of the user to dry and straighten the hair shafts 23. Power would be communicated to the fan motor through the aforementioned mounting apertures 110 cooperatively engaging the mounting pins 108 in the same fashion as that of the cutting unit assembly 15. As such, using the serpentine hair channel 58 and the determined amount of rise of the distal ends 25 through the elongated slot 51, the various attachable components from the kit can be mounted to either cut more or less hair from the distal ends 25, dry the hair, or to allow the use of shears by hand.

While all of the fundamental characteristics and features of the present invention has been described herein, with reference to particular embodiments thereof, a latitude of modification, various changes and substitutions are intended in the foregoing disclosure and it will be apparent that in some instance, some features of the invention will be employed without a corresponding use of other features without departing from the scope of the invention as set forth. It should be understood that such substitutions, modifications, and variations may be made by those skilled in the art without departing from the spirit or scope of the invention. Consequently, all such modifications and variations are included within the scope of the invention as defined by the following claims.

What is claimed is:

1. A hair trimming apparatus for trimming the distal ends of hair drawn therethrough, comprising:

a body assembly having a handle attached at one end and having a head mating end;

a motor mounted in said body assembly communicating with an electric power source;

a cutting head assembly mountable on said head mating end of said body assembly, said cutting head assembly having a face with a retainer cavity formed therein;

a slot located in said retainer cavity communicating with an interior cavity of said cutting head assembly;

an elongated hair retainer rotatably mounted at a first end and cooperatively engageable with said retainer cavity;

said elongated hair retainer having an operating position cooperatively engaged in said retainer cavity and having a raised position, disengaged from said retainer cavity;

an activating lever operatively engaged with said elongated hair retainer at said first end for moving said elongated hair retainer from said raised position to said operating position;

a cutter blade assembly operatively mounted in said interior cavity, said cutter blade assembly having a cutting blade attached to a cutting frame, said cutter blade assembly operatively engaged with said motor when mounted in said interior cavity;

said elongated hair retainer when cooperatively engaged with said slot, forming a serpentine path for guiding hair strands through said cutting head assembly;

said slot allowing said distal ends of said hair strands drawn through said serpentine path to momentarily communicate through said slot into said interior cavity; and said cutting blade positioned in said interior cavity to cut portions off said distal ends of said hair strands communicating through said slot.

2. The hair trimming apparatus as defined in claim 1 additionally comprising:

said cutter blade assembly removably mounted in said interior cavity.

3. The hair trimming apparatus as defined in claim 2 additionally comprising:

a plurality of cutter blade assemblies each removably mountable in said interior cavity;

each of said plurality of cutter blade assemblies configured to cut a defined length of said distal ends of said hair strands whereby said defined length of said distal end removed from said hair strand is adjustable by changing to another cutter blade assembly from said plurality of cutter blade assemblies.

4. The hair trimming apparatus as defined in claim 1 additionally comprising:

an elongated face plate;

said face plate having an engagement side configured for cooperative mounted engagement with said retainer cavity;

said face plate having a hair retainer side, said hair retainer side cooperatively engageable with said elongated hair retainer when in said operating position;

said face plate when in cooperative mounted engagement with said retainer cavity thereby changing the dimension of said retainer cavity a defined amount resulting in a change of tension imparted to said hair strands traveling said serpentine path.

5. The hair trimming apparatus as defined in claim 4 additionally comprising:

a plate kit having a plurality of said face plates; and each of said plurality of said face plates dimensioned to change said dimension of said retainer cavity a different of said defined amount.

6. The hair trimming apparatus as defined in claim 1 additionally comprising:

a kit of cutting head assemblies having a plurality of cutting head assemblies in said kit;

each of said plurality of cutting head assemblies in said kit removably mountable to said body assembly; and each of said plurality of cutting head assemblies having said cutting blade mounted in said interior cavity at a point to cut said portions of hair a different length.

7. The hair trimming apparatus as defined in claim 1 additionally comprising a switch, said switch activatable to reverse said motor, thereby allowing said hair trimming apparatus to be pulled through the hair with either hand with correct rotation of said blade to cut portions off said distal ends of said hair strands.

8. The hair trimming apparatus as defined in claim 1 additionally comprising:

means for hair alignment of the said distal ends with said cutting blade.

9. The hair trimming apparatus as defined in claim 8 wherein said means for hair alignment of the said distal ends with said cutting blade comprises:

a grill located in said slot, said grill having a plurality of grill apertures communicating therethrough;

said distal ends communicating with said cutting blade through said grill apertures.

10. The hair trimming apparatus as defined in claim 9 additionally comprising:

a plurality of spines located on said hair retainer, said splines having gaps therebetween;

said gaps being substantially in line with said grill apertures when said hair retainer is in said operating position thereby forming a plurality of individual serpentine pathways for guiding hair strands through said slot and around said elongated hair retainer.

11. The hair trimming apparatus as defined in claim 8 additionally comprising a switch, said switch activateable to reverse said motor, thereby allowing said hair trimming apparatus to be pulled through the hair with either hand with correct rotation of said blade to cut portions off said distal ends of said hair strands.

12. A hair trimming apparatus for trimming the distal ends of hair drawn therethrough, comprising:

a handle having a front face and a rear face;

a first side lobe attached to an upper end of said handle said first side lobe having a first front face and a first rear face;

a second side lobe, parallel to said first side lobe, attached to said upper end of said handle, said second side lobe having a second front face, and a second rear face;

a retainer cavity formed between said first side lobe and said second side lobe;

an elongated slot in said retainer cavity, said slot providing communication from the base of said slot to a cutting area between said first rear face and said second rear face;

an elongated hair retainer rotatably mounted at a first end to said upper end of said handle, said elongated hair retainer cooperatively engageable with said retainer cavity;

said elongated hair retainer having an operating position cooperatively engaged in said retainer cavity and having a raised position, disengaged from said retainer cavity;

an activating lever operatively engaged with said elongated hair retainer for moving said elongated hair retainer from said raised position to said operating position;

said elongated hair retainer when cooperatively engaged with said slot, forming a serpentine path for guiding hair strands through said elongated slot and around said elongated hair retainer;

said slot allowing said distal ends of said hair strands drawn through said serpentine path to momentarily communicate through said slot into said cutting area;

a cutting assembly having a cutting blade operatively mounted in an interior cavity of said cutting assembly;

a motor operatively engaged with said cutting blade, said motor attached to said cutting assembly;

a cutting slot in a front face of said cutting assembly providing communicating with said cutting blade in said interior cavity;

means for registered engagement of said front face of said cutting assembly to said first rear face and said second rear face with said cutting slot in registered alignment with said elongated slot; and means to communicate electric power from said handle to said motor, whereby hair strands drawn through said serpentine path momentarily communicate through said elongated slot and into said cutting slot and said cutting blade removes a defined portion of the distal ends of said hair strands.

13. The hair trimming apparatus as defined in claim 12 additionally comprising:

a kit of cutting assemblies having a plurality of cutting assemblies in said kit;

each of said plurality of cutting assemblies in said kit removably mountable to said rear face; and each of said plurality of cutting assemblies having said cutting blade mounted therein a point to cut a different length defined portion of said distal ends of said hair strands.

14. The hair trimming apparatus as defined in claim 13 wherein a hair dryer is a member of said kit of cutting blade assemblies.

15. The hair trimming apparatus as defined in claim 12 additionally comprising a hair dryer component, said hair dryer component operatively attachable to said rear face.

16. The hair trimming apparatus as defined in claim 12 additionally comprising:

means for hair alignment of the said distal ends with said cutting blade.

17. The hair trimming apparatus as defined in claim 16 wherein said means for hair alignment of the said distal ends with said cutting blade comprises:

a grill located in said elongated slot, said grill having a plurality of grill apertures communicating therethrough;

said distal ends communicating with said cutting blade through said grill apertures.

18. The hair trimming apparatus as defined in claim 17 additionally comprising:

a plurality of spines located on said hair retainer, said splines having gaps therebetween;

said gaps being substantially in line with said grill apertures when said hair retainer is in said operating position thereby forming a plurality of individual serpentine pathways for guiding hair strands through said elongated slot and around said elongated hair retainer.

19. The hair trimming apparatus as defined in claim 12 additionally comprising a switch, said switch activateable to reverse said motor, thereby allowing said hair trimming apparatus to be pulled through the hair with either hand with correct rotation of said blade to cut portions off said distal ends of said hair strands.

* * * * *